US008763571B2

(12) United States Patent
Gilbert et al.

(10) Patent No.: US 8,763,571 B2
(45) Date of Patent: Jul. 1, 2014

(54) AIR SUPPLY FOR COMPONENTS OF A SPLIT-CYCLE ENGINE

(75) Inventors: Ian P. Gilbert, Shoreham-by-Sea (GB); Anthony S. Perkins, Shoreham-by-Sea (GB); Jean-Pierre Pirault, Shoreham-by-Sea (GB); Riccardo Meldolesi, Shoreham-by-Sea (GB)

(73) Assignee: Scuderi Group, Inc., West Springfield, MA (US)

( * ) Notice: Subject to any disclaimer, the term of this patent is extended or adjusted under 35 U.S.C. 154(b) by 621 days.

(21) Appl. No.: 12/775,504

(22) Filed: May 7, 2010

(65) Prior Publication Data

US 2010/0282225 A1 Nov. 11, 2010

Related U.S. Application Data

(60) Provisional application No. 61/176,263, filed on May 7, 2009.

(51) Int. Cl.

| | |
|---|---|
| ***F02B 21/00*** | (2006.01) |
| ***F02B 33/22*** | (2006.01) |
| ***F02B 75/02*** | (2006.01) |
| *F02D 17/02* | (2006.01) |

(52) U.S. Cl.

CPC ..... *F02B 21/00* (2013.01); *F02B 33/22* (2013.01); *F02B 75/021* (2013.01); *F02D 17/026* (2013.01)

USPC ..... 123/70 R; 123/64; 123/68; 123/53.5; 123/90.14; 60/597

(58) Field of Classification Search

CPC ..... F02B 33/22; F02B 75/021; F02B 29/00; F02B 17/026; F02B 33/06; F02B 33/02; F02D 21/02; F02D 17/026

USPC ..... 123/70 R, 188.2, 90.14, 90.12, 90.15, 123/39, 431, 68, 198 E, 53.5; 251/12, 48; 60/597

See application file for complete search history.

(56) References Cited

U.S. PATENT DOCUMENTS

| | | | |
|---|---|---|---|
| 1,936,653 | A | 11/1933 | Almen |
| 2,109,809 | A | 3/1938 | Van Ranst |
| 2,394,354 | A | 2/1946 | Barr |

(Continued)

FOREIGN PATENT DOCUMENTS

| | | | |
|---|---|---|---|
| DE | 10115967 | A1 | 10/2002 |
| GB | 2250801 | A | 6/1992 |

(Continued)

OTHER PUBLICATIONS

International Search Report, International Application No. PCT/US2010/034046, dated Jul. 7, 2010.

*Primary Examiner* — Rinaldi Rada
*Assistant Examiner* — Kevin Lathers
(74) *Attorney, Agent, or Firm* — Nutter McClennen & Fish LLP; John J. Penny, Jr.; Michael P. Visconti, III

(57) ABSTRACT

The present invention generally relates to providing an air supply for components associated with an engine. More particularly, the present invention relates to a system and method for using compressed air generated by a split-cycle engine to power components such as valves or air springs associated with the split-cycle engine.

7 Claims, 5 Drawing Sheets

(56) References Cited

U.S. PATENT DOCUMENTS

| | | | | |
|---|---|---|---|---|
| 2,772,667 | A | 12/1956 | Nallinger | |
| 3,209,737 | A | 10/1965 | Isao | |
| 3,774,581 | A | 11/1973 | Lundy | |
| 3,786,792 | A | 1/1974 | Pelizzoni et al. | |
| 3,808,818 | A | 5/1974 | Cataldo | |
| 3,880,126 | A | 4/1975 | Thurston et al. | |
| 3,908,701 | A | 9/1975 | Dawawala | |
| 3,938,483 | A | 2/1976 | Firey | |
| 3,949,964 | A | 4/1976 | Freeman | |
| 4,133,172 | A | 1/1979 | Cataldo | |
| 4,224,798 | A * | 9/1980 | Brinkerhoff | 60/652 |
| 4,418,657 | A | 12/1983 | Wishart | |
| 4,825,717 | A | 5/1989 | Mills | |
| 4,860,716 | A | 8/1989 | Deutschmann | |
| 4,934,652 | A | 6/1990 | Golden | |
| 5,018,487 | A | 5/1991 | Shinkai | |
| 5,193,495 | A | 3/1993 | Wood, III | |
| 5,402,756 | A | 4/1995 | Bohme et al. | |
| 5,555,861 | A | 9/1996 | Mayr et al. | |
| 5,690,066 | A | 11/1997 | Hampton et al. | |
| 5,713,316 | A | 2/1998 | Sturman | |
| 5,964,087 | A | 10/1999 | Tort-Oropeza | |
| 5,988,124 | A | 11/1999 | Duesmann | |
| 6,152,714 | A | 11/2000 | Mitsuya et al. | |
| 6,192,841 | B1 | 2/2001 | Vorih et al. | |
| 6,230,472 | B1 | 5/2001 | Stahlecker | |
| 6,230,742 | B1 | 5/2001 | Bircann | |
| 6,273,057 | B1 | 8/2001 | Schwoerer et al. | |
| 6,302,370 | B1 | 10/2001 | Schwoerer et al. | |
| 6,332,917 | B1 * | 12/2001 | Schollkopf | 96/397 |
| 6,397,579 | B1 | 6/2002 | Negre | |
| 6,412,457 | B1 | 7/2002 | Vorih et al. | |
| 6,474,277 | B1 | 11/2002 | Vanderpoel et al. | |
| 6,510,824 | B2 | 1/2003 | Vorih et al. | |
| 6,543,225 | B2 | 4/2003 | Scuderi | |
| 6,584,885 | B2 | 7/2003 | Lou | |
| 6,609,371 | B2 | 8/2003 | Scuderi | |
| 6,647,954 | B2 | 11/2003 | Yang et al. | |
| 6,655,327 | B1 | 12/2003 | Hedman | |
| 6,874,453 | B2 | 4/2005 | Coney et al. | |
| 6,883,775 | B2 * | 4/2005 | Coney et al. | 251/48 |
| 6,952,923 | B2 | 10/2005 | Branyon et al. | |
| 7,140,332 | B2 | 11/2006 | Klein et al. | |
| 7,156,062 | B2 | 1/2007 | Vanderpoel | |
| 7,171,930 | B2 | 2/2007 | Keel | |
| 7,353,786 | B2 * | 4/2008 | Scuderi et al. | 123/68 |
| 7,481,190 | B2 | 1/2009 | Scuderi | |
| 7,513,224 | B2 | 4/2009 | Heaton | |
| 7,536,984 | B2 | 5/2009 | Lou | |
| 7,603,970 | B2 | 10/2009 | Scuderi et al. | |
| 7,628,126 | B2 | 12/2009 | Scuderi | |
| 7,637,234 | B2 | 12/2009 | Tussing et al. | |
| 7,690,337 | B2 | 4/2010 | Pirault et al. | |
| 7,810,459 | B2 | 10/2010 | Branyon et al. | |
| 7,823,547 | B2 | 11/2010 | Forner, Sr. et al. | |
| 7,963,259 | B2 | 6/2011 | Meldolesi et al. | |
| 2002/0185091 | A1 | 12/2002 | Vorih et al. | |
| 2003/0019444 | A1 * | 1/2003 | Suh et al. | 123/70 R |
| 2005/0022768 | A1 | 2/2005 | Tores et al. | |
| 2005/0132987 | A1 | 6/2005 | Chang | |
| 2005/0268609 | A1 | 12/2005 | Branyon et al. | |
| 2006/0273271 | A1 | 12/2006 | Yang et al. | |
| 2007/0157894 | A1 | 7/2007 | Scuderi et al. | |
| 2008/0054205 | A1 | 3/2008 | Lou | |
| 2008/0202454 | A1 | 8/2008 | Pirault | |
| 2008/0251041 | A1 | 10/2008 | Lou | |
| 2009/0038596 | A1 | 2/2009 | Pirault et al. | |
| 2009/0038598 | A1 | 2/2009 | Phillips | |
| 2009/0044778 | A1 | 2/2009 | Scuderi et al. | |
| 2009/0056670 | A1 * | 3/2009 | Zhao et al. | 123/25 P |
| 2009/0133648 | A1 | 5/2009 | Lou | |
| 2010/0126442 | A1 | 5/2010 | Lou | |
| 2010/0180847 | A1 | 7/2010 | Meldolesi et al. | |
| 2010/0180848 | A1 | 7/2010 | Meldolesi et al. | |
| 2010/0263646 | A1 | 10/2010 | Giannini et al. | |
| 2010/0282225 | A1 | 11/2010 | Gilbert et al. | |
| 2010/0300385 | A1 | 12/2010 | Durrett et al. | |

FOREIGN PATENT DOCUMENTS

| | | | |
|---|---|---|---|
| GB | 2340881 | A | 3/2000 |
| JP | 40-10860 | A | 1/1992 |
| JP | 10-274105 | A | 10/1998 |
| JP | 2004-293695 | A | 10/2004 |
| WO | 2006094213 | A1 | 9/2006 |

* cited by examiner

AIR SUPPLY FOR COMPONENTS OF A SPLIT-CYCLE ENGINE

CROSS REFERENCE TO RELATED APPLICATIONS

This application claims the benefit of U.S. Provisional Patent Application No. 61/176,263 filed May 7, 2009, the contents of which are incorporated by reference herein.

TECHNICAL FIELD

The present invention generally relates to providing an air supply for components associated with an engine. More particularly, the present invention relates to a system and method for using compressed air generated by a split-cycle engine to power components such as valves or air springs associated with the split-cycle engine.

BACKGROUND OF THE INVENTION

For purposes of clarity, the term "conventional engine" as used in the present application refers to an internal combustion engine wherein all four strokes of the well known Otto or Diesel cycles (the intake, compression, expansion and exhaust strokes) are contained in each piston/cylinder combination of the engine. Each stroke requires one half revolution of the crankshaft (180 degrees crank angle (CA)), and two full revolutions of the crankshaft (720 degrees CA) are required to complete the entire Otto or Diesel cycle in each cylinder of a conventional engine.

Also, for purposes of clarity, the following definition is offered for the term "split-cycle engine" as may be applied to engines disclosed in the prior art and as referred to in the present application.

A split-cycle engine comprises:

a crankshaft rotatable about a crankshaft axis;

a compression piston slidably received within a compression cylinder and operatively connected to the crankshaft such that the compression piston is operable to reciprocate through an intake stroke and a compression stroke during a single rotation of the crankshaft;

an expansion (power) piston slidably received within an expansion cylinder and operatively connected to the crankshaft such that the expansion piston is operable to reciprocate through an expansion stroke and an exhaust stroke during a single rotation of the crankshaft; and a crossover passage interconnecting the compression and expansion cylinders, the crossover passage including a crossover compression (XovrC) valve and a crossover expansion (XovrE) valve operable to define a pressure chamber therebetween.

U.S. Pat. No. 6,543,225 granted Apr. 8, 2003 to Carmelo J. Scuderi (herein the "Scuderi patent"), U.S. Pat. No. 6,952,923 granted Oct. 11, 2005 to David P. Branyon et al. (herein the "Branyon patent"), and U.S. Pat. No. 7,353,786 granted Apr. 8, 2008 to Scuderi et al. (herein the "Air-Hybrid patent") each contain an extensive discussion of split-cycle and similar type engines. In addition the Scuderi, Branyon, and Air-Hybrid patents disclose details of prior versions of engines of which the present invention comprises a further development. The Scuderi, Branyon, and Air-Hybrid patents are each hereby incorporated by reference in their entirety.

Referring to FIG. 1, a prior art split-cycle engine of the type similar to those described in the Branyon and Scuderi patents is shown generally by numeral 50. The split-cycle engine 50 replaces two adjacent cylinders of a conventional engine with a combination of one compression cylinder 66 and one expansion cylinder 68. The four strokes of the Otto or Diesel cycle are "split" over the two cylinders 66 and 68 such that the compression cylinder contains the intake and compression strokes and the expansion cylinder 68 contains the expansion and exhaust strokes. The Otto or Diesel cycle is therefore completed in these two cylinders 66, 68 once per crankshaft 52 revolution (360 degrees CA).

During the intake stroke, intake air is drawn into the compression cylinder 66 through an inwardly opening (opening inward into the cylinder) poppet intake valve 82. During the compression stroke, the compression piston 72 pressurizes the air charge and drives the air charge through one or more crossover passages 78, which act as the intake passages for the expansion cylinder 68.

The volumetric compression ratio of the compression cylinder of a split-cycle engine is herein referred to as the "compression ratio" of the split-cycle engine. The volumetric compression ratio of the expansion cylinder of a split-cycle engine is herein referred to as the "expansion ratio" of the split-cycle engine. Due to very high compression ratios (e.g., 40 to 1, 80 to 1, or greater), outwardly opening (opening outward away from the cylinder) poppet crossover compression (XovrC) valves 84 at the inlet of each of the one or more crossover passages 78 are used to control flow from the compression cylinder 66 into the one or more crossover passages 78. Due to very high expansion ratios (e.g., 40 to 1, 80 to 1, or greater), outwardly opening poppet crossover expansion (XovrE) valves at the outlet of each of the one or more crossover passages 78 control flow from the one or more crossover passages 78 into the expansion cylinder 68. The actuation rates and phasing of the XovrC and XovrE valves 84, 86 are timed to maintain pressure in the one or more crossover passages 78 at a high minimum pressure (typically 20 bar or higher at full load) during all four strokes of the Otto or Diesel cycle.

One or more fuel injectors 90 (one for each crossover passage 78) inject fuel into the pressurized air at the exit end of the one or more crossover passages 78 in correspondence with the XovrE valve(s) 86 opening, which occurs shortly before the expansion piston 74 reaches its top dead center position. The fuel-air charge fully enters the expansion cylinder 68 shortly after the expansion piston 74 reaches its top dead center position. As expansion piston 74 begins its descent from its top dead center position, and while the XovrE valve(s) 86 is/are still open, the spark plug 92 is fired to initiate combustion (typically between 10 to 20 degrees CA after top dead center of the expansion piston 30). The XovrE valve(s) 86 is/are then closed before the resulting combustion event can enter the one or more crossover passages 78. The combustion event drives the expansion piston 74 downward in a power stroke. Exhaust gases are pumped out of the expansion cylinder 68 through an inwardly opening poppet exhaust valve 88 during the exhaust stroke.

With the split-cycle engine concept, the geometric engine parameters (i.e., bore, stroke, connecting rod length, compression ratio, etc.) of the compression and expansion cylinders are generally independent from one another. For example, the crank throws 56, 58 for the compression cylinder 66 and expansion cylinder 68 respectively may have different radii and may be phased apart from one another with top dead center (TDC) of the expansion piston 74 occurring prior to TDC of the compression piston 72. This independence, among other factors, enables the split-cycle engine to potentially achieve higher efficiency levels and greater torques than typical four stroke engines.

Considerable research has been devoted to air hybrid engines, which store energy for later use in the form of compressed air. The split-cycle engine 50 shown in FIG. 1 can be combined with an air tank and various control features to provide an air hybrid system.

FIG. 2 illustrates an exemplary prior art split-cycle air-hybrid engine. Referring to FIG. 2 in detail, a prior art split-cycle engine 50 is shown of the type described in FIG. 1. One or more of the one or more crossover passages 78 are connected to an air tank 94 via a control valve 93. Valve 93 is opened and closed at appropriate times to control the flow of air between the air tank 94 and the one or more crossover passages 78. Compressed air from the one or more crossover passages 78 is stored in the air tank at certain times such as, for example, when the vehicle is braking. The compressed air in the air tank 94 is fed back into the one or more crossover passages 78 at a later time in order to drive the crankshaft 54 in a pre-compressed air power (PAP) mode. The PAP mode can include a pre-compressed combustion-air power mode, wherein pre-compressed air and fuel are mixed and the fuel/air mixture is combusted to drive the power piston down during an expansion stroke. Further, the PAP mode can include various air motoring (AM) modes, wherein pre-compressed air is utilized to drive the power piston down during an expansion stroke without a corresponding combustion event occurring in the expansion cylinder. The Air-Hybrid patent describes details of the PAP modes of operation and other aspects of a split-cycle air hybrid engine similar to the one shown in FIG. 2.

The actuation mechanisms (not shown) for valves 82, 84, 86, 88 may be cam driven or camless. In general, a cam driven mechanism includes a camshaft mechanically linked to the crankshaft. A cam is mounted to the camshaft, and has a contoured surface that controls the profile of the valve lift (i.e. the valve lift from its valve seat, versus rotation of the crankshaft). A cam driven actuation mechanism is efficient and fast, but has limited flexibility.

Also in general, camless actuation systems for valves are known, and include systems that have one or more combinations of mechanical, hydraulic, pneumatic, and/or electrical components or the like. Camless systems allow for greater flexibility during operation, including, but not limited to, the ability to change the valve lift height and duration and/or deactivate the valve at selective times. Pneumatically actuated camless valves are generally advantageous for various reasons such as their compact packaging, low energy consumption requirements, and relatively low cost.

Dynamic actuation of the crossover valves 84, 86 of split-cycle engine 50 is very demanding. This is because the crossover valves 84 and 86 must achieve sufficient lift to fully transfer the fuel-air charge in a very short period of crankshaft rotation (generally in a range of about 30 to 60 degrees CA) relative to that of a conventional engine, which normally actuates the valves for a period of at least 180 degrees CA. This means that the crossover valves 84, 86 must actuate about four to six times faster than the valves of a conventional engine.

Valve springs (not shown) for the valves 82, 84, 86, 88 are used to keep the valves 82, 84, 86, 88 closed when they are not being actuated. Any suitable valve springs can be used for the intake valve 82 and the exhaust valve 88 such as mechanical springs or air springs. However, the crossover valves 84, 86 preferably use air springs because standard mechanical springs can have difficulty closing the crossover valves 84, 86 quickly enough to meet the aforementioned demanding crossover valve actuation requirements.

Pneumatic actuators, air springs, and other pneumatically powered components generally require a steady source of cool, dry, compressed air at a constant pressure that is free of particulates. These components generally need a steady source of such compressed air because, inter alia, compressed air tends to leak. Accordingly, there is a need in the art for providing such a compressed air source with an engine, more particularly with a split-cycle engine.

SUMMARY OF THE INVENTION

The present invention satisfies the aforementioned needs/problems in the art by providing an air supply for components associated with a split-cycle engine. More particularly, the present invention processes air generated by a split-cycle engine to power components of the split-cycle engine such as valves and air springs.

These and other advantages can be accomplished in an exemplary embodiment of the present invention by providing a system for supplying compressed air to a component requiring a supply of compressed air. The system can comprise an engine comprising a crankshaft rotatable about a crankshaft axis, a compression piston slidably received within a compression cylinder and operatively connected to the crankshaft such that the compression piston is operable to reciprocate through an intake stroke and a compression stroke during a single rotation of the crankshaft, an expansion (power) piston slidably received within an expansion cylinder and operatively connected to the crankshaft such that the expansion piston is operable to reciprocate through an expansion stroke and an exhaust stroke during a single rotation of the crankshaft, and a crossover passage interconnecting the compression and expansion cylinders, the crossover passage including a crossover compression (XovrC) valve and a crossover expansion (XovrE) valve operable to define a pressure chamber therebetween. The system can be operable to supply the component with compressed air compressed by the compression piston.

These and other advantages can be accomplished in a further exemplary embodiment of the present invention by providing a system for supplying compressed air to a component requiring a supply of compressed air. The system may comprise an engine, comprising a crankshaft rotatable about a crankshaft axis, a compression piston slidably received within a compression cylinder and operatively connected to the crankshaft such that the compression piston is operable to reciprocate through at least an intake stroke and a compression stroke, and an air tank operable to store compressed air compressed by the compression piston. The system may be configured to supply compressed air from the air tank to the component and to an expansion cylinder for performing at least an expansion stroke and an exhaust stroke.

These and other advantages of the present invention will be more fully understood from the following detailed description of the invention taken together with the accompanying drawings.

DETAILED DESCRIPTION OF THE INVENTION

First Embodiment

Figure 1:
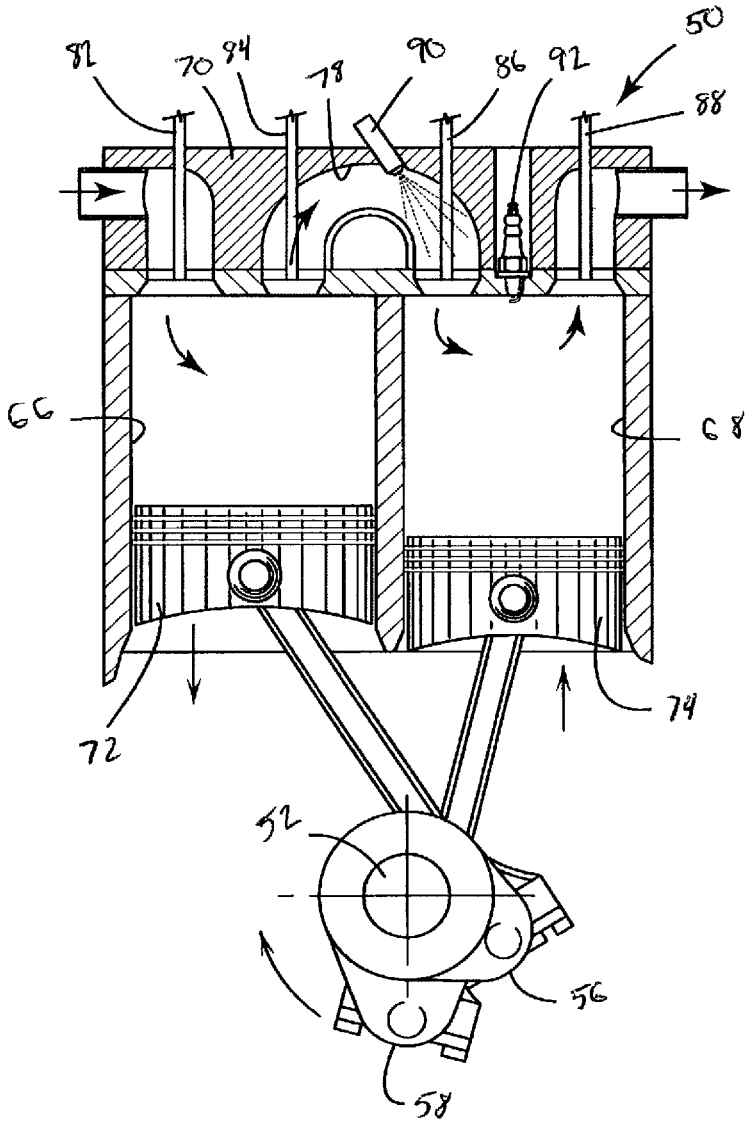
FIG. 1 Prior Art
FIG. 1 is a cross-sectional view of a prior art split-cycle engine.
Figure 3:
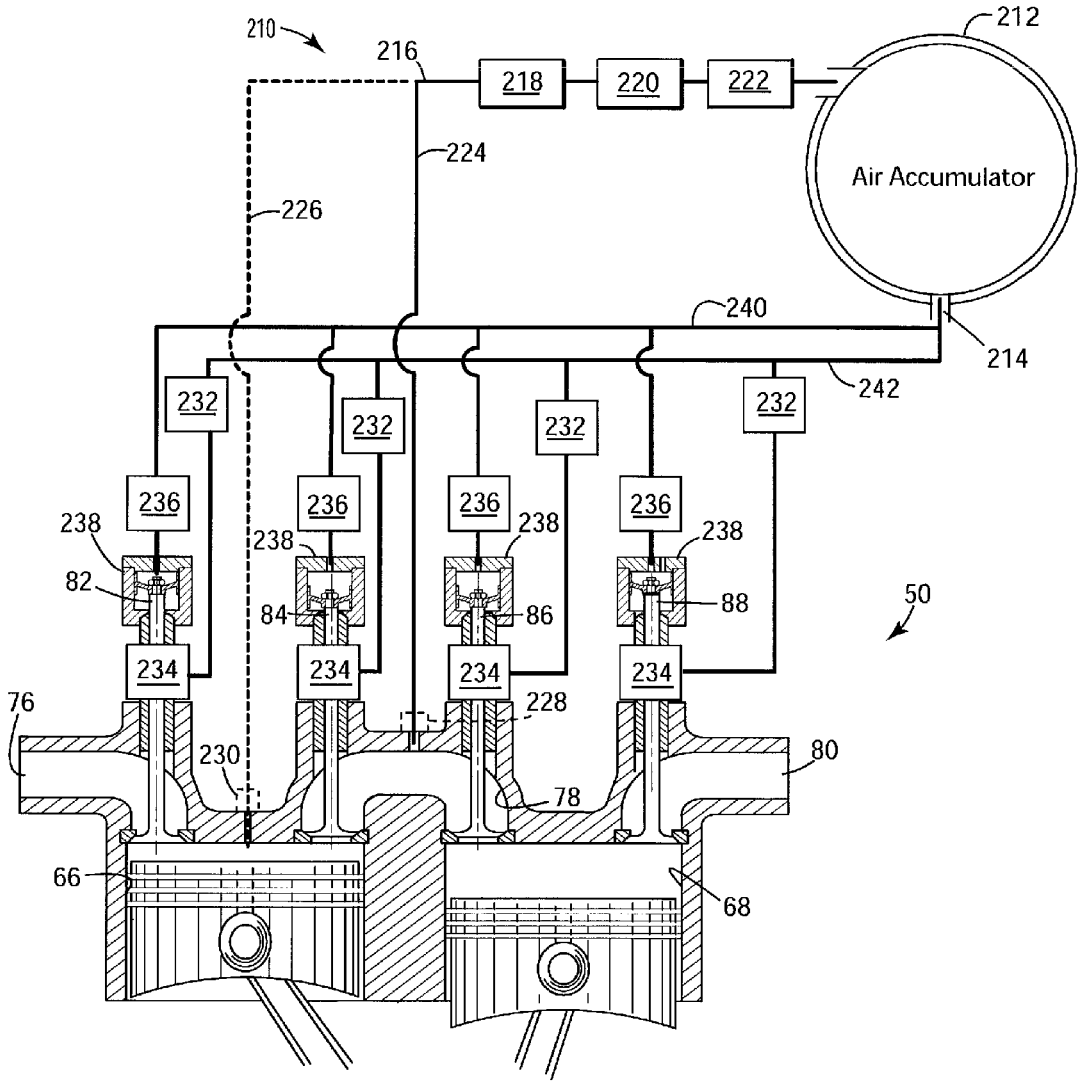
FIG. 3 is a schematic view of a system for supplying compressed air to components associated with a split-cycle engine according to a first embodiment of the present invention.

Referring now to the first embodiment of FIG. 3 in detail, numeral 50 generally indicates a diagrammatic representation of a split-cycle engine of the type shown in FIG. 1. According to the present invention, compressed air generated by the split-cycle engine 50 is supplied to air actuators 234 for actuating the valves 82, 84, 86, 88 and to air springs 238 for supporting the valves 82, 84, 86, 88.

Compression cylinder 66 draws in intake air during the intake stroke of the engine 50. The compression piston 72 pressurizes the air charge and drives the air charge into the one or more crossover passages 78. One or more check valves 228 in the one or more crossover passages 78 (preferably one check valve 228 in each crossover passage 78) control flow of compressed air into an air processing system 210 through one or more air input lines 224. The air input lines 224 can preferably connect directly from the crossover passage(s) 78 to the air processing system 210. Though check valves are utilized for this embodiment, other appropriately designed valves may also be used, e.g., poppet valves. Alternatively, one or more small orifices (preferably one orifice in each crossover passage 78) can be used in place of the one or more check valves 228. Orifice(s) can generally be advantageous because of their potentially improved cost and packaging considerations in relation to check valves.

Alternatively to air supply line 224 or in combination with air supply line 224, a second air supply line 226 can be used to supply compressed air to the air processing system 210. The second air supply line 226 connects the compression cylinder 66 directly (i.e., not through one or more crossover passages 78) to the air processing system 210 as shown in FIG. 3 via a check valve 230. In other words, the compression piston 72 pressurizes an air charge and drives some or all of the air charge into the air supply line 226 through valve 230, thereby bypassing the one or more crossover passages 78. Alternatively, a poppet valve or an orifice can be used in place of the check valve 230. Again, orifices may generally be advantageous because of potentially improved cost and packaging considerations.

After the compressed air enters the air processing system 210 via one or both of air input lines 224, 226, the compressed air travels through an air input line 216, which runs successively through various components of the air processing system 210. Specifically, the compressed air is run successively through an air cooler 218 that cools the compressed air, an air filter 220 that removes particulates from the compressed air, and an air dryer 222 that removes water vapor from the compressed air. Next, the processed compressed air is stored in an air accumulator 212. Alternative air processing systems 210 can also be used that include additional elements such as a pre-filter at air entry, a fine filter as a last stage, or elements in a different order, as is well known in the art.

Air accumulator 212 is connected to air supply lines 240, 242. Air supply lines 240, 242 supply the processed compressed air to the components that require a supply of compressed air, for example, pneumatic actuators 234 for actuating pneumatically any of the valves 82, 84, 86, 88 or air springs 238 for supporting any of the valves 82, 84, 86, 88. Air supply lines 240, 242 each run through air pressure regulators 232, 236. Air pressure regulators 232 can regulate the pressure supplied to the pneumatic actuators 234 such that the pressure of the air supplied to the pneumatic actuators 234 is substantially constant. Similarly, air pressure regulators 236 regulate the pressure supplied to the air springs 238 such that the pressure of the air supplied to the air springs 238 is substantially constant. Air pressure regulators 232 and/or air pressure regulators 236 can optionally be variable pressure regulators, which could be advantageous in that this could allow a reduction in air pressure at low engine speeds, thereby reducing friction.

Individual pneumatic actuators 234 and individual air springs 238 each utilize separate air pressure regulators because each component can have different air pressure requirements. One of ordinary skill in the art would of course readily appreciate that groups of components with the same air pressure requirements could use a single air pressure regulator for the group.

Second Embodiment

Figure 2:
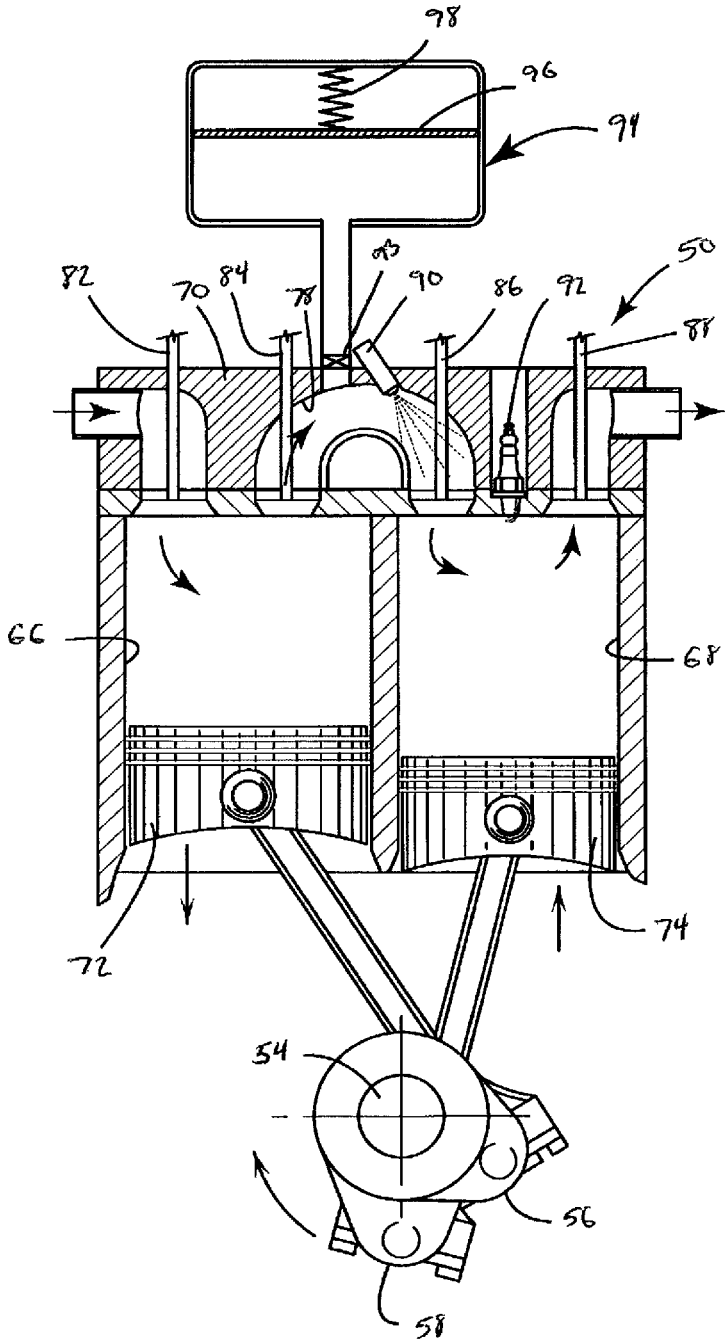
FIG. 2 Prior Art
FIG. 2 is a cross-sectional view of a prior art split-cycle air-hybrid engine.
Figure 4:
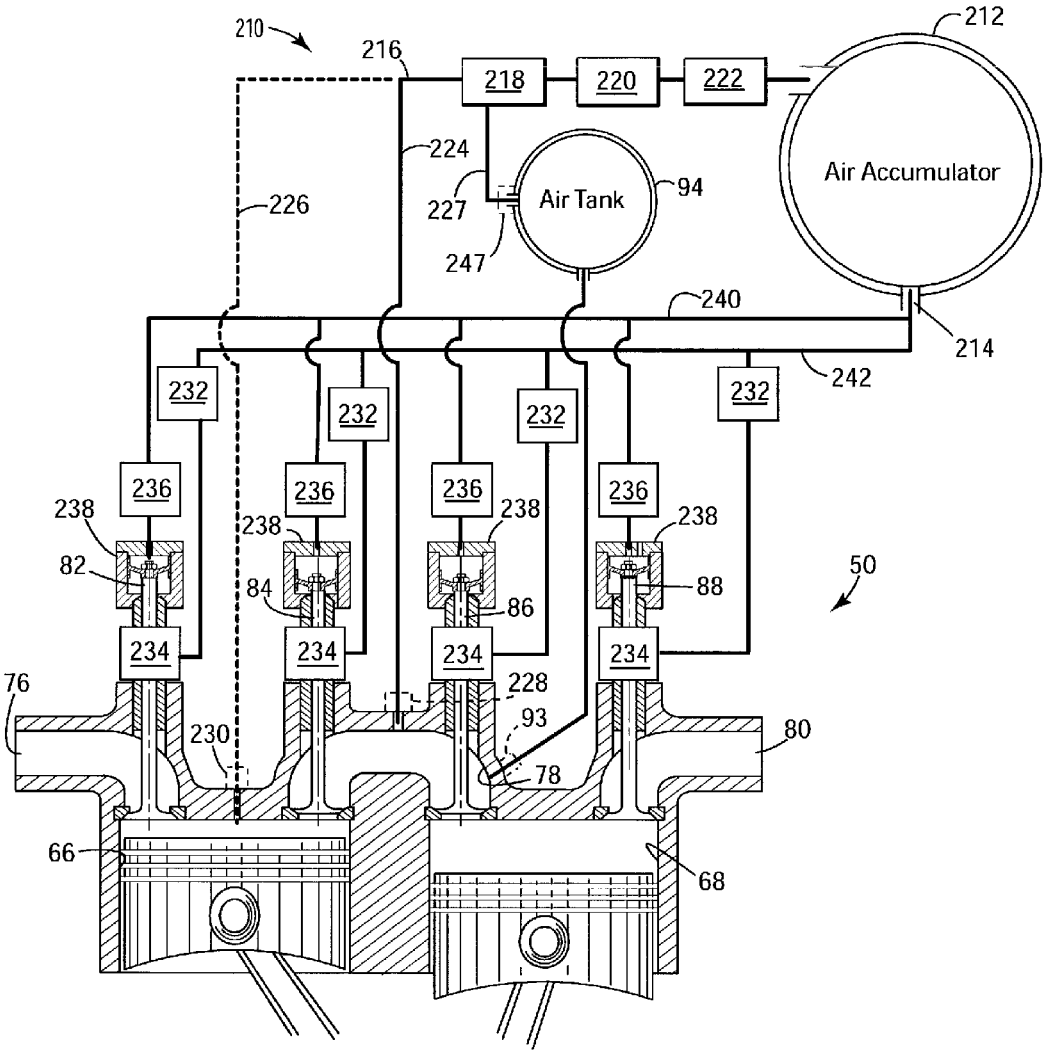
FIG. 4 is a schematic view of a system for supplying compressed air to components associated with a split-cycle air-hybrid engine according to a second embodiment of the present invention.

FIG. 4 shows a second air-hybrid embodiment of the present invention. In this second embodiment, the split-cycle engine 50 is a split-cycle air hybrid engine. That is, the split-cycle engine further includes an air tank 94 (shown schematically) similar to the air tank detailed in FIG. 2. Compressed air from the one or more crossover passages 78 is fed into the air tank 94 through valve 93, which can be a solenoid valve or any other appropriate type of valve. The air tank 94 is thereby used to store energy in the form of compressed air. At an appropriate time, the compressed air stored in the air tank 94 can be fed back into the one or more crossover passages 78 in order to power the crankshaft 54. Further implementation details of operations modes of the air hybrid configuration are provided in the Air-Hybrid patent.

An air input line 227 connects the air tank 94 to the air processing system 210 (of the type described in reference to the first embodiment) via a check valve 247. Compressed air can enter the air processing system via the air input lines 224, 226 (as in the first embodiment). However, in this second embodiment, compressed air can be fed into the air processing system 210 directly from the air tank 94 via air input line 227. Air input line 226 can optionally be used as a further supply of compressed air for the air processing system 210. The air processing system 210 of the second embodiment otherwise operates in the same manner as in the first embodiment to supply processed compressed air to components such as air actuators 234 and air springs 238.

Much of the compressed air stored in air tank 94 can be used to drive the expansion piston 74 of the engine 50. The air tank 94 is preferably insulated in order to prevent energy loss during this process. On the other hand, the air accumulator 212, which can have a substantially smaller volume than the air tank 94, does not necessarily require such insulation because the air accumulator 212 stores cooled air for alternative purposes.

Figure 5:
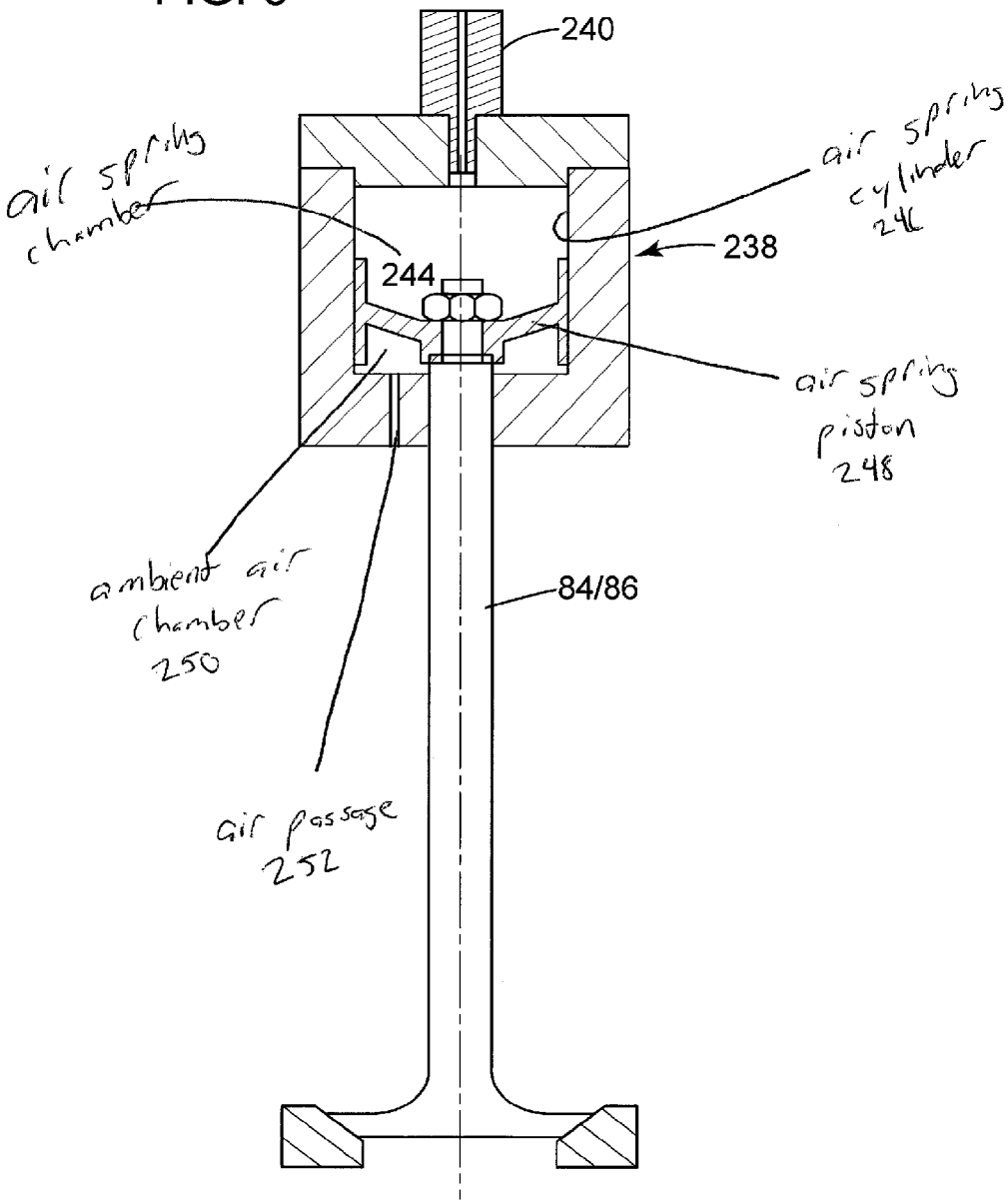
FIG. 5 is a cross-sectional view of an air spring for a crossover valve of a split-cycle engine, which is supplied with compressed air according to the present invention.

Referring to FIG. 5, a cross sectional view of an air spring 238 for a crossover valve 84, 86 of the split-cycle engine 50 is shown. Air spring 238 comprises an air spring cylinder 246 within which an air spring piston 248 reciprocates. The air spring piston 248 and a sealing element (not shown) create a substantial seal within the air spring cylinder 246. The air spring 238 is connected to air supply line 240, which supplies the processed compressed air to a pressurized air spring chamber 244 created by the aforementioned substantial seal. The air spring further includes an ambient air chamber 250, which is connected to external ambient air via an air passage 252. The compressed air in the air spring chamber 244 applies pressure to the crossover valve 84/86 to stay in its closed position, as shown.

The invention disclosed herein uses compressed air generated by a split-cycle engine to power various components of the split-cycle engine. This powers the components in a convenient, cost reducing, and efficient manner. While various embodiments are shown and described herein, various modifications and substitutions may be made thereto without departing from the spirit and scope of the invention. Accordingly, it is to be understood that the present invention has been described by way of illustration and not limitation.

What is claimed is:

1. A system for supplying compressed air to a component requiring a supply of compressed air, the system comprising:

an engine, comprising:

a crankshaft rotatable about a crankshaft axis;

a compression piston slidably received within a compression cylinder and operatively connected to the crankshaft such that the compression piston is operable to reciprocate through an intake stroke and a compression stroke during a single rotation of the crankshaft;

an expansion (power) piston slidably received within an expansion cylinder and operatively connected to the crankshaft such that the expansion piston is operable to reciprocate through an expansion stroke and an exhaust stroke during a single rotation of the crankshaft;

a crossover passage interconnecting the compression and expansion cylinders, the crossover passage including a crossover compression (XovrC) valve and a crossover expansion (XovrE) valve operable to define a pressure chamber therebetween;

an air tank connected to the crossover passage via a control valve, the air tank being operable to store compressed air supplied from the crossover passage and feed compressed air into the crossover passage;

an air processing system operable to process compressed air compressed into the crossover passage by the compression piston and supply processed, compressed air to the component; and a first air input line connected directly between the crossover passage and the air processing system, the first air input line operable to supply compressed air from the crossover passage to the air processing system;

wherein the air processing system is operable to process the compressed air compressed by the compression piston prior to supplying the compressed air to the component;

wherein the air processing system comprises a cooler for cooling compressed air and an air pressure regulator for controlling air pressure supplied to the component such that the air pressure supplied to the component is substantially constant; and wherein the component comprises at least one of an air spring that supports a valve operable to control fluid communication to or from at least one of the compression cylinder, the expansion cylinder, and the crossover passage and a pneumatic actuator for a pneumatically actuated valve operable to control fluid communication to or from at least one of the compression cylinder, the expansion cylinder, and the crossover passage.

2. The system of claim 1, wherein the system is operable to supply the component with compressed air from the crossover passage.

3. The system of claim 1, wherein the air processing system comprises a filter for removing particulates from compressed air.

4. The system of claim 1, wherein the air processing system comprises a drier for removing water vapor from compressed air.

5. The system of claim 1, wherein the air processing system comprises an accumulator for storing compressed air.

6. The system of claim 1, further comprising a second air input line connected directly between the air tank and the air processing system, the second air input line operable to supply compressed air from the air tank to the air processing system.

7. The system of claim 6, further comprising a third air input line connected directly between the compression cylinder and the air processing system, the third air input line operable to supply compressed air from the compression cylinder to the air processing system.

* * * * *